United States Patent [19]

Bindschatel

[11] 4,400,886

[45] Aug. 30, 1983

[54] DOOR AND JAMB MORTISING PILOT

[76] Inventor: Lyle D. Bindschatel, 303 Holiday Lake Dr. East, Holiday, Fla. 33590

[21] Appl. No.: 257,396

[22] Filed: Apr. 24, 1981

[51] Int. Cl.[3] ..... B27G 17/08

[52] U.S. Cl. ..... 33/197; 33/174 G

[58] Field of Search ..... 33/197, 174 G; 144/27

[56] References Cited

U.S. PATENT DOCUMENTS

| | | | |
|---|---|---|---|
| 1,462,231 | 7/1923 | Fouse | 33/458 |
| 1,788,256 | 1/1931 | Sherwin | 33/197 X |
| 2,854,761 | 10/1958 | Graham | 33/197 |
| 3,082,800 | 3/1963 | Soss | 144/27 |
| 3,789,892 | 2/1974 | Converse et al. | 33/197 X |

*Primary Examiner*—Harry N. Haroian

*Attorney, Agent, or Firm*—Ronald E. Smith

[57] ABSTRACT

An improved door and jamb mortising pilot having the capability of performing numerous mortising operations effortlessly; having hinges to enable folding to a compact unit; having slide locks to prevent unintentional folding; having fixed guide pins to affect perfect alignment on a door or jamb; having a non-adjusting permanent rotating door and jamb margin spacer; having two alternative means of attachment to a door or jamb, specifically, anchor pins and gripping devices; having mortising guide templates that are interchangable to accommodate popular size hinges; and having mortising guide template pin locks to ensure position of mortising guide templates; said folding door and jam mortising pilot being highly adaptable but completely eliminating measurements and adjustments.

8 Claims, 18 Drawing Figures

3
2

2
1

10
27
22
23
1
4

10
22
23

20
8
20
18
20
19
20
20

7
17
6
3

7
17

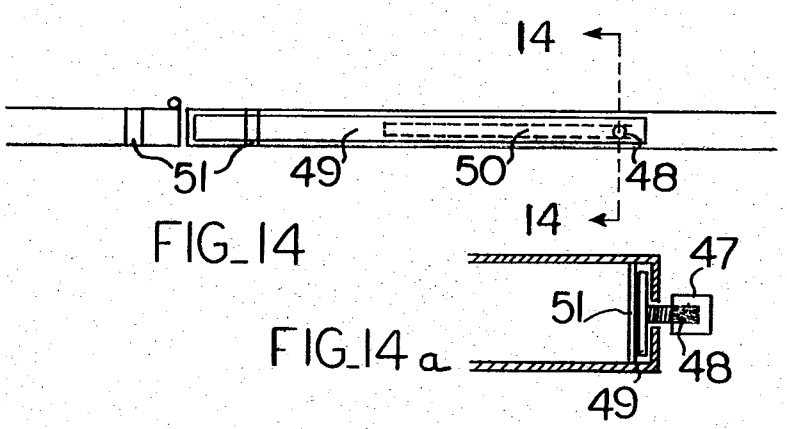
FIG_14
FIG_14a
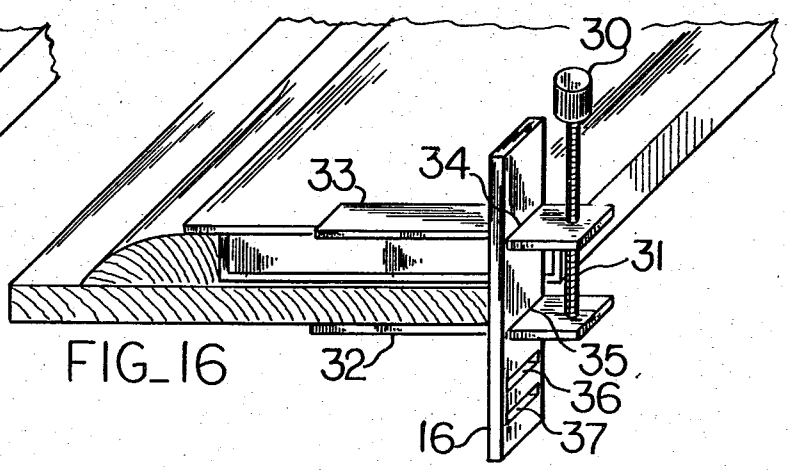
FIG_16
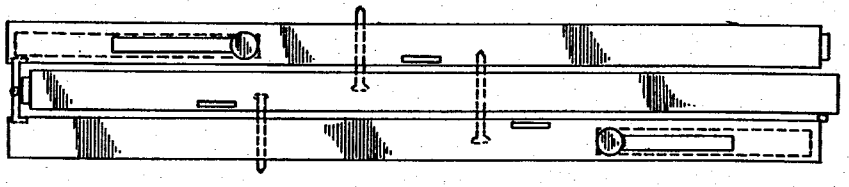
FIG_17
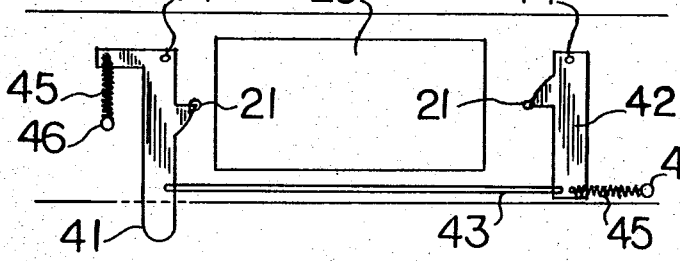
FIG_13
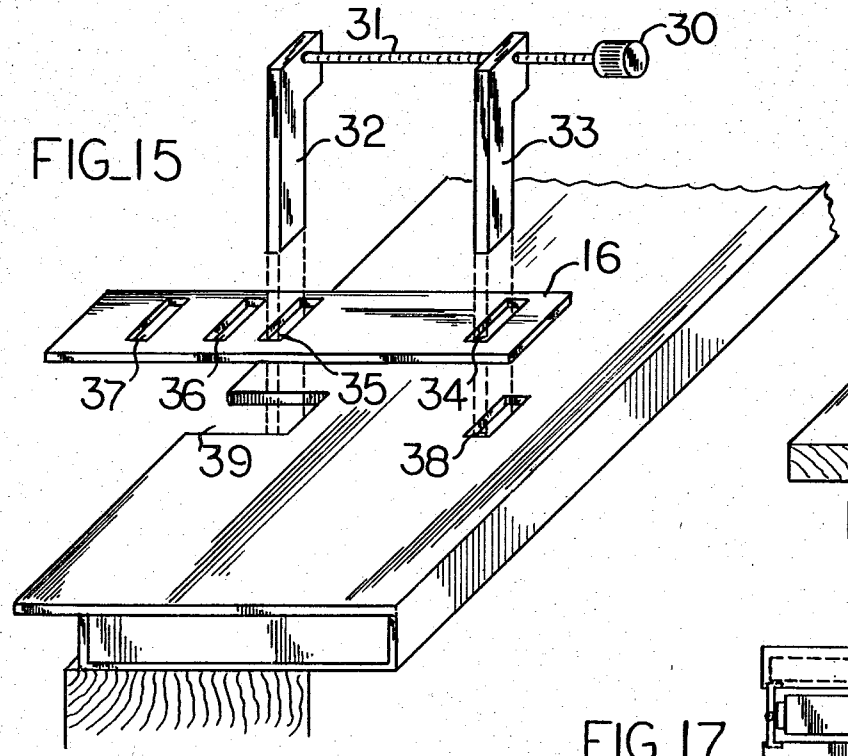
FIG_15

DOOR AND JAMB MORTISING PILOT

This invention relates to a mortising pilot for use in mortising wooden doors and jambs to accept butt hinges.

An object of this invention is to provide improved means of mortising hinge recesses in doors and jambs.

Another object of this invention is to provide a door and jamb mortising pilot which makes it possible to mortise doors and jambs with extreme precision, thus eliminating tedious measuring and fitting procedures, and thereby reducing the amount of time necessary to mortise hinge recesses in doors and jambs.

Another object of this invention is to provide a door and jamb mortising pilot which is lighter in weight, easier to handle, and cheaper to manufacture than any previous door and jamb mortising pilot.

Another object of this invention is to provide a mortising pilot which can be attached to several thicknesses of doors and jambs either by means of anchor pins or by means of gripping devices in the case where holes in the door and jamb are undesirable.

Another object of this invention is to provide a mortising pilot with several quickly interchangable mortising guide templates of different sizes and shapes, eliminating tedious measuring and adjusting.

Another object of this invention is to provide a mortising pilot that is instantly reversible from door to jamb, eliminating measuring and adjusting, ensuring perfect accuracy of fit, and ensuring a precise door margin without measuring, adjusting, or sighting. p Another object of this invention is to provide a door and jamb mortising pilot that folds to a convenient size, easy to carry and easier to store than any previous mortising pilot, and that involves no assembly to use except inserting the desired mortising guide templates, and that requires no diassembly after use.

Other objects of this invention will be apparent from the following description taken in connection with the accompanying drawings.

Figures 6, 7, 8, 9, 10, 11, 12:
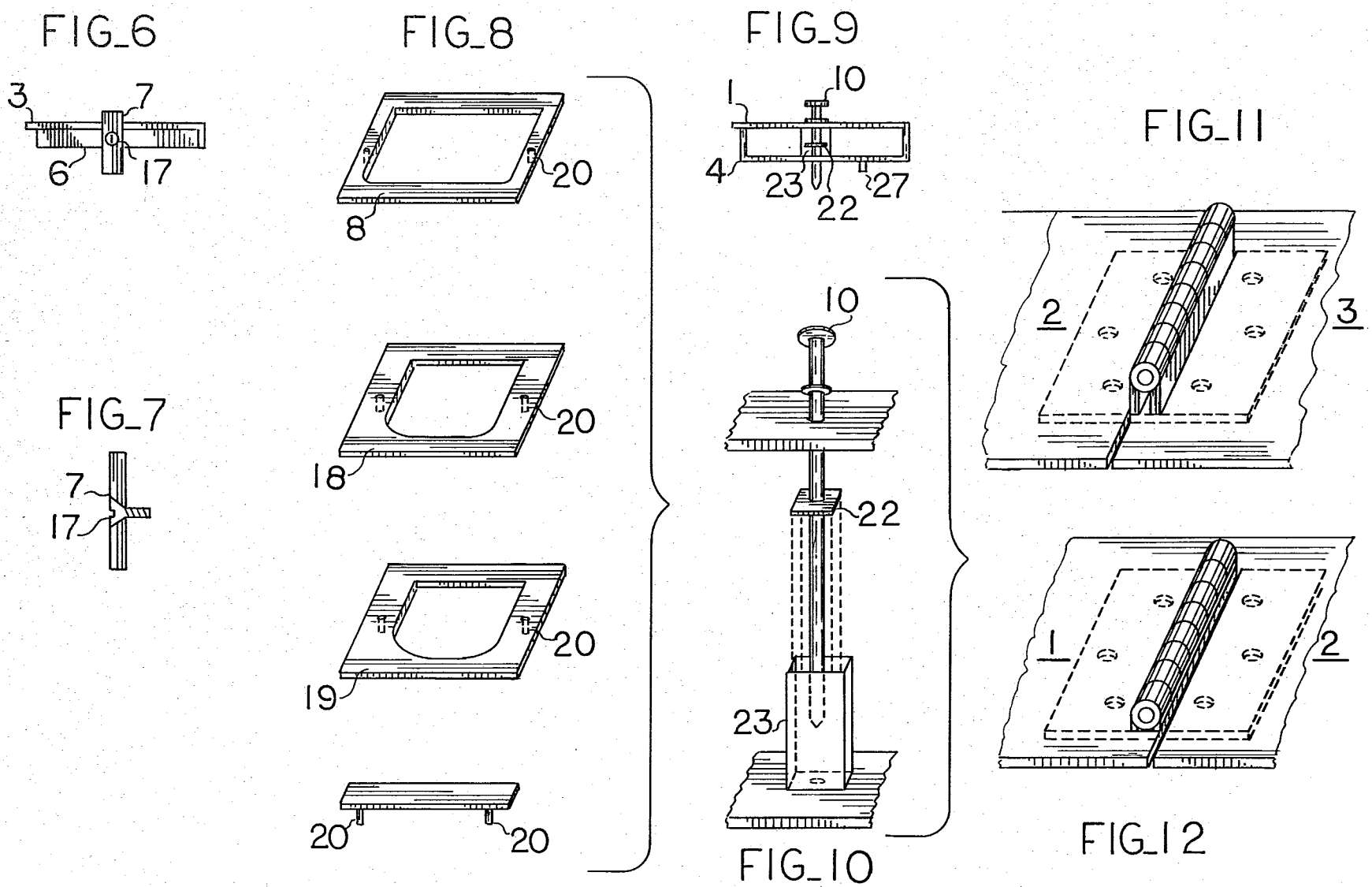
FIG. 6 is an end view of said mortising pilot showing the door and jamb margin spacer.
FIG. 7 is an edge cross-section of the door and jamb margin spacer shown in FIG. 6.

FIG. 8 shows mortising guide templates: four-inch template 8 for one-quarter inch round-corner hinges, three-and-one-half inch template 18 for one-quarter inch round-corner hinges, and three-and-one-half inch template 19 for three-quarter inch round-corner hinges; and showing mortising guide template pin 20.

Figures 1, 2, 3, 4, 5:
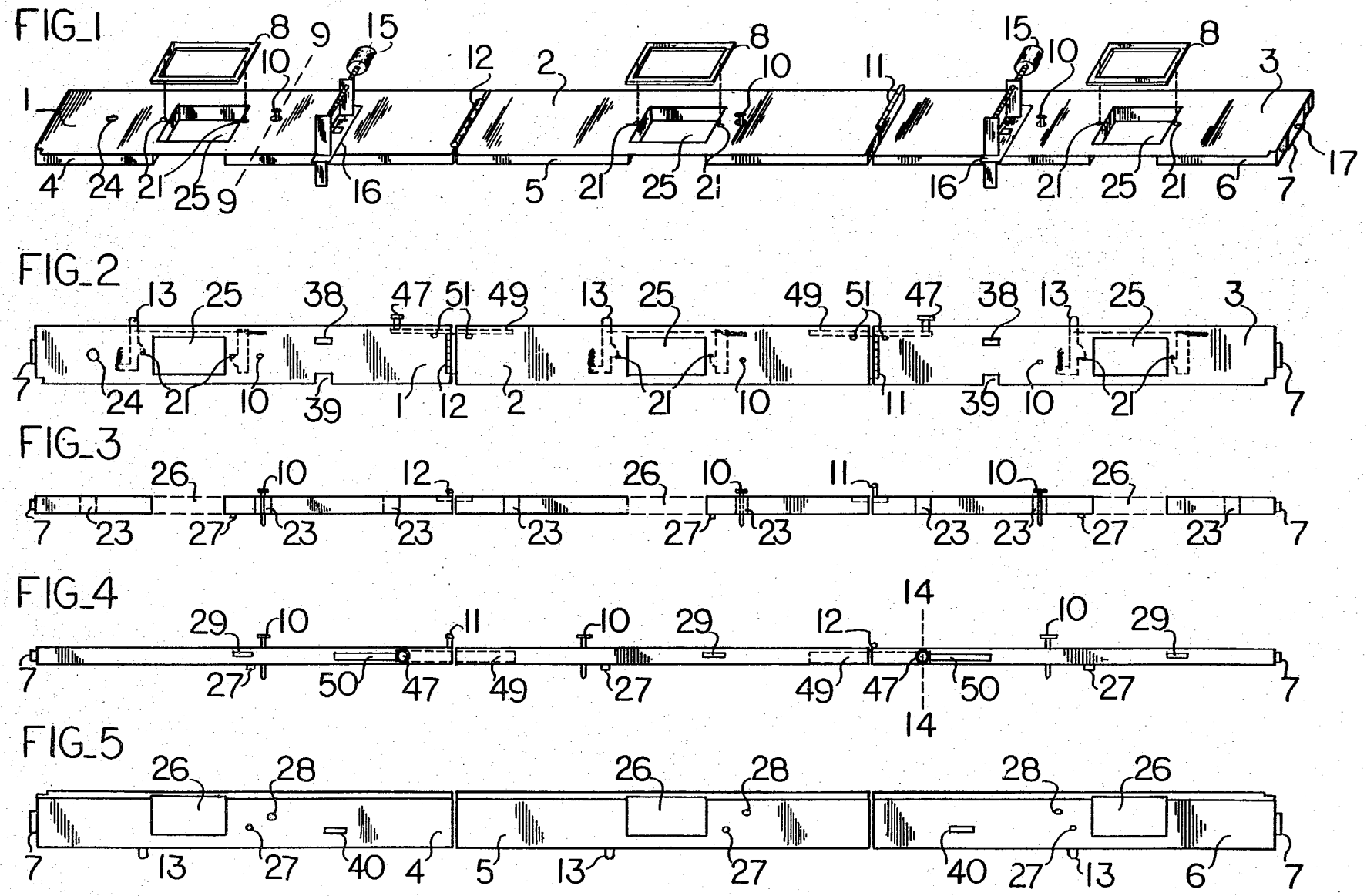
FIG. 1 is an overall perspective view of the Folding Door and Jamb Mortising Pilot constructed in accordance with this invention.
FIG. 2 is a top plan view of said mortising pilot.
FIG. 3 is a front plan view of said mortising pilot.
FIG. 4 is a back plan view of said mortising pilot.
FIG. 5 is a bottom plan view of said mortising pilot.

FIG. 9 is a cross-section taken substantially on broken line 9—9 of FIG. 1, showing anchor pin and mortising pilot guide pin.

FIG. 10 is an exploded partial view of FIG. 9, showing construction of the anchor pin inside a pilot spacr.

FIG. 11 is a perspective view of hinge 11 of FIG. 1 and showing its location on said mortising pilot.

FIG. 12 is a perspective view of hinge 12 of FIG. 1 and showing its location on said mortising pilot.

FIG. 13 is a partial interior plan view of the top of said mortising pilot, showing composition of mortising template pin locks 13 of FIG. 2.

FIG. 14 is an interior back side view showing the slide lock of FIG. 4 in the open position.

FIG. 14*a* is a cross-sectional view taken along line 14—14 of FIG. 14.

FIG. 15 shows the assembly of gripping device and slotted gripper bar guide through said mortising pilot for a door.

FIG. 16 shows the assembly of said gripping device and slotted gripper bar guide through said mortising pilot for a jamb.

FIG. 17 is a back view of said mortising pilot in the folded position.

Like reference numerals refer to like parts throughout the several views.

FIGS. 1, 2, 3, 4, and 5 show a door and jamb mortising pilot made up of three metal sections, each of equal length, twenty-five-and-five-sixteenths inches, to accommodate standard six-foot-eight-inch doors and their respective jambs, secured together by hinges 11 and 12 which enable said mortising pilot to fold.

The three pilot sections each are constructed of two L-shaped pieces, top 1 corresponding to bottom 4, to 2 corresponding to bottom 5, top 3 corresponding to bottom 6, each top section being five-eighths inch wide at the back side, three inches wide on top, and one-half inch wider than its corresponding bottom section, enabling said mortising pilot to fit on a jamb with the door stop in place.

Said top sections 1, 2, and 3 are attached to bottom sections 4, 5, and 6 of said mortising pilot by means of screws, to allow access to inner working parts in the event that a repair is necessary.

The left front edge of top 1 and the right front edge of top 3 each have a small square-shaped piece cut out to enable said mortising pilot to fit on either the right side or the left side of a jamb when the overhead door stop is in place.

Located at each end of said mortising pilot is a door and jamb margin spacer 7, constructed of steel one-eighth inch thick by one-half inch wide by one inch long, and being attached to the bent up end of bottom sections 4 and 6 of said mortising pilot by means of a screw 17. An end view of said mortising pilot showing said margin spacer 7 is given in FIG. 6. When said margin spacer 7 is in a position perpendicular to the end of said mortising pilot, said margin spacer 7 hooks over the top of a door, providing a one-eighth inch door margin. On a jamb, said margin spacer 7 is in a position parallel to the end of said mortising pilot, providing the one-eighth inch margin space.

Sections 1 and 3 have mortising opening 25, beginning seven inches from their respective ends and measuring four-and-one-eighth inches long and two-and-seven-eighths inches wide. Mortising opening 25 of center section 2 is exactly centered and has the same dimensions. Adjacent to each mortising opening 25 are two guide template pin holes 21, each centered between the edges as shown in FIG. 2.

Mortising openings 26 in bottom sections 4, 5, and 6 correspond to mortising openings 25 in their respective top sections. As shown in FIG. 3, the front side of the bottom sections is cut out to allow router to mortise hinge recesses on a jamb when the door stop is in place.

Mortising guide templates are constructed of a metal that will not be damaged by the operation of an electric router. Three different types of mortising guide templates are shown in FIG. 8. Other sizes and shapes can be made compatible for use with said mortising pilot.

Each mortising guide template has two mortising guide template pins 20 at the center of each end of said template. Said template pins 20 are inserted into guide template pin holes 21 and are held in place by mortising guide template pin locks 13.

Said template pin locks 13 are shown in detail in FIG. 13. Pin lock bar 41 protrudes out back side of said mortising pilot through slot 29, in FIG. 4, for locking and releasing. Said pin lock bar 41 and pin lock bar 42 are attached to the interior of the top section of said mortising pilot by means of rivets 44, located as shown in FIG. 13. A steel wire 43 connects pin lock bars 41 and 42 at a position behind mortising opening 25. Springs 45 are attached to pin lock bars 41 and 42 in the positions shown and to the interior of the top section of said mortising pilot by means of rivets 46. Said pin locks 13 are normally in the locked position. When installation of a mortising guide template is desired, protruding portion of said pin lock bar 41 is pushed in the direction away from mortising opening 25, mortising guide template is inserted, and pin lock bar 41 is released. Mortising guide template is now locked in place. To withdraw mortising guide template, push pin lock bar 41 in the direction away from mortising opening 25, lift out template, and release pin lock bar 41.

Each of the three sections of said mortising pilot has an anchor pin 10, located three inches from mortising openings 25 to allow sufficient room for an electric router to operate. As shown in FIG. 10, anchor pin 10 consists of a double-headed nail with a washer 22 pressed on in the interior of said mortising pilot. Said anchor pin 10 fits inside a pilot spacer 23, which ensures that said anchor pin 10 remains in conjunction with anchor pin hole 28 in each bottom section. Said washer 22 restricts said anchor pin 10 so that it has a limited field of vertical movement. The double head of said anchor pin 10 enables the removal of said mortising pilot from a door or jamb by means of a hammer claw, when said mortising pilot has been attached to a door or jamb by means of the three anchor pins 10.

Said mortising pilot spacers 23 also are inserted inside said mortising pilot at several other locations, as shown in FIG. 3. to give said mortising pilot strength and stability. Said pilot spacers 23 are attached to the bottom sections 4, 5, and 6 of said mortising pilot by means of electric spot welding.

Each of the bottom sections 4, 5, and 6 of said mortising pilot has a guide pin 27 in close proximity to mortising openings 26. The purpose of said guide pins 27 is to align said mortising pilot on any door in the proper position for the hinge recesses to be routered.

The two end sections of said mortising pilot each have a gripping device 15 as an alternative means of attaching said mortising pilot to a door or jamb, for use when the holes made by the anchor pins 10 would be undesirable, as in the case of solid oak doors and jambs.

Said gripping device 15 consists of two gripper bars 32 and 33, gripper bar 32 being attached to the end of threaded rod 31 so as to remain in this location, gripper bar 33 being movable along said threaded rod 31, thereby being adjustable for doors of different thicknesses, most commonly one-and-three-eighths inch and one-and-three-quarter inch doors. Said threaded rod 31 has a gripper handle 30 to facilitate said adjustment. When used on a one-and-three-eighths inch door, as shown in FIG. 15, gripper bar 32 inserts through slot 35 of slotted gripper bar guide 16 and then through cut-out 39 in said mortising pilot; gripper bar 33 inserts through slot 34 of said slotted gripper bar guide 16 and then through slot 38 in top and slot 40 in bottom of said mortising pilot. To enable said gripping device 15 to grip a door, gripper handle 30 is turned clockwise causing gripper bar 33 to move closer to said gripping handle 30, expanding the top of said gripping device 15, which in turn contracts the bottom ends of said gripper bars 32 and 33, tightening said gripper bars 32 and 33 on the door surface. Operation of said gripping device 15 on a one-and-three-quarter inch door is the same except that gripper bar 32 is inserted through slot 36 of said slotted gripper bar guide 16.

Said gripping device 15 is shown installed on a jamb in FIG. 16. Here the slotted gripper bar guide 16 is inserted through slot 38 in top and slot 40 in bottom of said mortising pilot, with slot 34 of said slotted gripper bar guide 16 exposed on top of said mortising pilot. For a five-eighths inch jamb, gripper bar 33 is inserted through slot 34 of said slotted gripper bar guide 16 and rests on the top surface of said mortising pilot; gripper bar 32 is inserted through slot 35 of said slotted gripper bar guide 16 and behind the jamb. Gripping device 15 operates in the same manner, compressing said mortising pilot to the jamb. Operation on a one-and-five-eighths inch jamb is the same except that gripper bar 32 is inserted through slot 37 of said slotted gripper bar guide 16.

Hinge 12, as shown in FIG. 12, projects one-quarter inch to enable folding and has eight knuckles to minimize excess movement in said mortising pilot. Said hinge 12 is attached to the underside of top sections 1 and 2 of said mortising pilot by means of rivets or electric spot welding. To accommodate said hinge 12 in a position to enable left-hand section of said mortising pilot to fold over center top section 2 of said mortising pilot, a cut-out is made at the right-hand end of top 1, the length and width necessary to fit said hinge 12 as shown in FIG. 12. When folded, head of anchor pin 10 of center section fits into anchor pin hole 24 in top 1 of said mortising pilot.

Hinge 11, as shown in FIG. 11, projects three-quarter inch for a mortising pilot of three-quarter inch width. Said hinge 11 is attached to the underside of tops 2 and 3 of said mortising pilot by means of rivets or electric spot welding. Said hinge 11 also has eight knuckles. To accommodate said hinge 11 in a position to enable the right-hand section to fold over after the left-hand section of said mortising pilot has been folded, a cut-out is made at the left-hand end of top 3, the length and width necessary to fit said hinge 11 as shown in FIG. 11. A back view of said mortising pilot in the folded position is shown in FIG. 17.

Hinges 11 and 12 have removable pins to enable removal of standard size center section and substitution of a longer center section for use of said mortising pilot on eight foot and ten foot doors.

To keep said mortising pilot in the open position, slide locks are provided. In FIG. 4, said slide locks are shown in the locked open position, which prevents said mortising pilot from folding unless said slide lock is reversed. FIG. 14 shows, respectively, slide lock in the position for folding, and a cross-section taken substantially on broken line 14—14 of FIG. 4. Lock knob 47 is attached to lock slide 49 by means of a short threaded rod 48. Tightening of said lock knob 47 locks said lock slide 49 into desired position. Threaded rod 48 protrudes through a long slot 50 in the back side of said mortising pilot. Said lock slide 49 is held in place against the interior back side of said mortising pilot by means of two lock slide guides 51, one near the end of each pilot section involved.

While the above description contains many specifics, these should not be construed as limitations on the scope of this invention, but rather as an exemplification of one preferred embodiment thereof. Changes may be made within the scope of the following claims.

I claim:

1. A door and jamb mortising pilot means, comprising, in combination, an elongate door and jamb pilot means of articulated construction, a plurality of mortising openings or apertures formed in said pilot means at pre-determined positions corresponding to the respective positions of hinge recesses to be formed, a plurality of interchangeble mortising guide template means, positioning means for positioning said template means in operative registration with each of said mortising openings formed in said pilot means, said positioning means including registration pin means provided as part of said template means, said positioning means further including aperture means formed in said pilot means for slidably receiving said registration pin means, and a biased locking means to maintain said template means in their respective operative positions when said apparatus is in use.

2. The pilot means of claim 1, wherein said pilot means is of trifurcated construction, having three individual, hingedly interconnected sections of substantially equal length so that said pilot means is foldable and thus storable in a relatively small space.

3. The pilot means of claim 2, further comprising a plurality of anchor pin means that extend through said pilot means, said anchor pin means having a distal end adapted to engage a door or jamb in a nail-like manner so that said pilot means is detachably securable to a door or jamb when said anchor pin means are driven into such door or jamb.

4. The pilot means of claim 3, wherein said anchor pin means have a proximal end adapted to be engaged by a nail pulling means.

5. The pilot means of claim 4, wherein said proximal end of said anchor pin means is a double headed nail member having a pair of vertically spaced head members, the lowermost of said head members limiting the depth of insertion of said distal end of said anchor pin means into a door or jamb.

6. The pilot means of claim 1, further comprising, means for releasably securing said mortising pilot means to a door, said means comprising a first flat base plate member having a plurality of apertures formed therein, said base plate member adapted to overlie said pilot means, said means further comprising first and second gripping plate members specifically configured to extend through associated ones of said apertures formed in said base plate means, said pilot means being apertured and notched to receive said first and second gripping plate members when said gripping plate members are extending through said associated apertures formed in said base plate means, said door disposed in sandwich relation to the respective distal ends of said first and second gripping plate means when said pilot means is operatively positioned relative to said door, and means for causing said distal ends to converge to compressively grip said door so that said pilot means is securely retained in an operative position relative to said door.

7. The pilot means of claim 6, wherein said means imparting convergence to said gripping plate members includes a threaded member having a first end rotatably secured to a proximal end of said first gripping plate member and a second end extending through an internally threaded, axially aligned proximal end of said second gripping plate member.

8. The pilot means of claim 1, further comprising, means for releasably securing said pilot means to a jamb, comprising, a flat base plate member adapted to overlie an edge of said mortising pilot means and a jamb, sand base plate member having a plurality of spaced aperture means formed therein, first and second gripping plate members adapted to extend through said aperture means formed in said base plate member, said pilot means and said jamb disposed in sandwiched relation to the distal ends of said gripping plate members when said gripping plate members extend through associated ones of said aperture means formed in said pilot means, and means for imparting convergence to said distal ends to thereby grip said pilot means and jamb, said means for imparting convergence including means for imparting divergence to the proximal end of said gripping plate members.

* * * * *